US008531070B2

(12) United States Patent
Takeda

(10) Patent No.: US 8,531,070 B2
(45) Date of Patent: Sep. 10, 2013

(54) PRESSURE-RESISTANT EXPLOSION-PROOF CONNECTOR

(75) Inventor: Sho Takeda, Higashimurayama (JP)

(73) Assignee: Nikkiso Co., Ltd., Tokyo (JP)

( * ) Notice: Subject to any disclaimer, the term of this patent is extended or adjusted under 35 U.S.C. 154(b) by 134 days.

(21) Appl. No.: 13/319,684

(22) PCT Filed: Feb. 3, 2011

(86) PCT No.: PCT/JP2011/052283

§ 371 (c)(1),
(2), (4) Date: Nov. 9, 2011

(87) PCT Pub. No.: WO2012/042919

PCT Pub. Date: Apr. 5, 2012

(65) Prior Publication Data

US 2012/0286601 A1 Nov. 15, 2012

(30) Foreign Application Priority Data

Sep. 27, 2010 (JP) ..... 2010-215035

(51) Int. Cl.
*H02K 5/10* (2006.01)

(52) U.S. Cl.
USPC ..... 310/88; 310/71; 310/87

(58) Field of Classification Search
USPC ..... 310/71, 87–89
See application file for complete search history.

(56) References Cited

U.S. PATENT DOCUMENTS 3,426,691 A 2/1969 Anderson
4,616,980 A * 10/1986 Carpenter ..... 417/357
5,117,138 A * 5/1992 Trian ..... 310/89
5,129,795 A * 7/1992 Hyland ..... 417/423.12
5,494,403 A * 2/1996 Kobayashi et al. ..... 415/182.1
5,627,420 A 5/1997 Rinker et al.
7,071,588 B1 * 7/2006 Khazanov ..... 310/71
7,579,727 B2 * 8/2009 Becker et al. ..... 310/71
8,203,242 B2 * 6/2012 Ihle et al. ..... 310/71
8,303,268 B2 * 11/2012 Werson et al. ..... 417/366

FOREIGN PATENT DOCUMENTS

JP 5131889 B2 9/1976
JP 8026867 B 3/1996
JP 2009054940 A 3/2009

OTHER PUBLICATIONS

Hermetic-Pumpen GmbH, Product Information, "Single-stage canned motor pumps complying with the chemical standards", Aug. 19, 2010.

International Search Report and Written Opinion of the International Searching Authority for International Application No. PCT/JP2011/052283, issued May 10, 2011.

* cited by examiner

*Primary Examiner* — Thanh Lam
(74) *Attorney, Agent, or Firm* — McCarter & English, LLP

(57) ABSTRACT

A pressure-resistant explosion-proof connector that allows even a different type of sensor to be mounted via a common connector, and thereby eliminates the need for replacement of each sensor is provided. A canned motor pump includes a centrifugal pump, a stand that supports a body, a motor, a bearing holder of the motor, a terminal flange mounted to an outer cylinder of the motor, a terminal box mounted onto the terminal flange, a motor monitoring unit mounted onto the terminal box, and a pressure-resistant explosion-proof connector mounted to the terminal flange. Also, the pressure-resistant explosion-proof connector includes a base joint mounted to the terminal flange, and a connection cylinder connected to the base joint, and a pressure sensor is connected to the distal end of the connection cylinder.

6 Claims, 10 Drawing Sheets

PRESSURE-RESISTANT EXPLOSION-PROOF CONNECTOR

CROSS-REFERENCE TO RELATED APPLICATIONS

This application is the U.S. National Phase of International Application No. PCT/JP2011/052283, entitled "Pressure-Resistant Explosion-Proof Connector", filed on Feb. 3, 2011, and claiming priority to Japanese Patent Application No. 2010-215053, filed Sep. 27, 2010, the disclosures of which are hereby incorporated by reference in their entireties.

TECHNICAL FIELD OF THE INVENTION

The present invention generally relates to a pressure-resistant explosion-proof connector for a canned motor pump, and more particularly to a pressure-resistant explosion-proof connector that connects external equipment to a sealed space of a stator portion that is hermetically sealed by an outer cylinder of a canned motor pump, an end bell, and a can in contact with a handled fluid.

BACKGROUND OF INVENTION

Pressure sensors or gas sensors for use in a flammable/explosive atmosphere such as factories and chemical plants are required to employ a structure meeting construction requirements for electrical equipment for explosive atmospheres. In the construction requirements for explosive atmospheres, various requirements are set for each of an intrinsic safety explosion-proof structure, a pressure-resistant explosion-proof structure, an increased safety explosion-proof structure, or the like. The above sensors preferably employ the intrinsic safety explosion-proof structure that does not trigger explosion as an explosion-proof structure. In the case of the intrinsic safety explosion-proof structure, however, a value of current flowing through equipment is limited, and even general sensors that operate by dry batteries of a few volts, for example, exceed the current limit for the intrinsic safety explosion-proof structure. Thus, it is difficult to employ the intrinsic safety explosion-proof structure. Japanese Patent Laid-Open Publication No. 2009-54940 discloses a pressure-resistant explosion-proof structure for information terminals that allows transmission and reception of information by use of optical communication such as infrared ray by accommodating equipment in a case having an explosion-proof structure in order to externally transmit and receive information in an explosion-proof atmosphere.

Flammable substances include a liquid such as petroleum and gas such as LPG and LNG. Highly-volatile petroleum evaporates even at a normal temperature, and its vapor or gas is mixed with the air to be possibly ignited and exploded by electrostatic sparks or faint electric sparks generated when a switch or the like is turned ON/OFF. Here, explosion means combustion accompanied by rapid changes in propagation speed, pressure and temperature. Also, combustion means a chemical reaction in which a substance combines with oxygen in the air, emitting light and heat, and requires a flammable substance, oxygen, and thermal energy such as a flame, electric spark, friction heat and reaction heat necessary for ignition.

The explosion-proof structures further include a pressurized explosion-proof structure that prevents a flammable substance from entering a case from outside by enclosing clean air or a nonflammable gas such as nitrogen within the case and thereby setting a pressure therein to be higher than that of the outside. However, when general sensors are used, an air flow or the like may affect measurement. Thus, it is preferable to employ a structure in which flame does not leak outside a case that accommodates the sensors even when combustion or explosion occurs inside the case, and an ignitable gas around the case, if any, is not ignited (the pressure-resistant explosion-proof structure).

There has been known a canned motor pump in which a special pressure switch is provided in a terminal box, as disclosed in HERMETIC-Pumpen GmbH, PRODUCT INFORMATION, "Single-stage canned motor pumps complying with the chemical standards", [online], Aug. 19, 2010, Internet, <URL: http://www.hermetic-pumpen.com/en/hermetic/products.html>. FIG. 7 is a sectional view of a terminal portion 100, and shows a terminal box 116 that is fitted with a terminal flange 117 connected to a sealed space of a stator portion. In the terminal flange 117, a stator coil connection line 111 extending from the stator portion is connected to a terminal 112, and a pressure switch 113 is arranged in the vicinity of the terminal 112. The pressure switch 113 has a mechanism whereby a diaphragm is deformed to connect an electric contact when a pressure reaches a preset value. Terminals 114 and 115 of the electric contact are arranged in the terminal box, and a pressure switch connection line is guided to outside from a pressure switch connection line mounting tool 119 of the terminal box 116. Similarly, the stator coil connection line 111 connected to the terminal is guided to outside from a coil connection line mounting tool 118.

In a canned motor pump, an inner portion of a stator of a motor that drives a centrifugal pump is covered by a can, and a handled liquid (for example, a flammable liquid) is filled therebetween, so that a rotating portion of the pump is immersed in the handled liquid and thus not required to be sealed. Also, since the stator is hermetically sealed by the can, a motor outer cylinder and an end bell, a sealed space is formed in the stator portion. Even when the can is damaged or the like, the liquid does not leak outside but enters the inner portion of the stator.

When the handled liquid enters the inner portion of the stator, insulation failure may occur in a stator coil to thereby damage the stator coil. To solve the problem, a pressure switch is provided in the sealed space of the stator portion, to detect a pressure increase due to the liquid leakage of the handled liquid and thereby determine that the liquid is leaking, as disclosed in HERMETIC-Pumpen GmbH, PRODUCT INFORMATION, "Single-stage canned motor pumps complying with the chemical standards", [online], Aug. 19, 2010, Internet, <URL: http://www.hermetic-pumpen.com/en/hermetic/products.html>.

However, when only a small amount of liquid leaks to cause little pressure increase, the pressure switch, as disclosed in HERMETIC-Pumpen GmbH, PRODUCT INFORMATION, "Single-stage canned motor pumps complying with the chemical standards", [online], Aug. 19, 2010, Internet, <URL: http://www.hermetic-pumpen.com/en/hermetic/products.html>, cannot accurately detect the liquid leakage. To detect such a small amount of liquid leakage, a highly-accurate electrical pressure sensor or a gas sensor needs to be used. When the pressure switch is replaced with the electrical pressure sensor or the gas sensor, the conventional terminal flange 117 including a mounting base needs to be replaced for each sensor, thereby causing an increase in cost.

Thus, it is an advantage of the present invention to provide a pressure-resistant explosion-proof connector that allows even a different type of sensor to be mounted via a common connector and thereby eliminates the need for replacement of a connector including a mounting base for each sensor.

SUMMARY OF THE INVENTION

To achieve the above advantage, a pressure-resistant explosion-proof connector according to the present invention is a pressure-resistant explosion-proof connector that connects external equipment to a sealed space of a stator portion hermetically sealed by a can in contact with handled fluid, an end bell, and an outer cylinder of a canned motor pump, including: a connection cylinder having a through hole extending from the sealed space toward the external equipment; a cylindrical body mounted to the through hole of the connection cylinder to form a gap and a width of an explosion-proof gap; and a base joint that connects the connection cylinder to the sealed space, wherein one end of the connection cylinder is connected to the canned motor pump through the base joint connected to the sealed space, the other end of the connection cylinder is connected to the external equipment through a joint connected to the external equipment, and the connection cylinder having the through hole has a structure to resist an inner pressure generated by leaking handled fluid or gas by receiving the cylindrical body from the sealed space side.

Also, in the pressure-resistant explosion-proof connector according to the present invention, the other end of the connection cylinder is hermetically sealed by the external equipment. According to this structure, a pressure-resistant explosion-proof structure formed therein is terminated at the connection cylinder, so that there is an advantage that the external equipment such as a sensor is not required to be pressure-resistant explosion-proof equipment with a special structure and specifications.

Also, the external equipment connected to the pressure-resistant explosion-proof connector according to the present invention intends to detect the handled liquid leaking into the sealed space of the stator portion, and can detect damage to the can by detecting a pressure change in the stator portion or a volatile gas component by use of a pressure sensor, a gas sensor, a temperature sensor or the like.

Also, in the pressure-resistant explosion-proof connector according to the present invention, a threaded groove is formed in the through hole of the connection cylinder, the cylindrical body has a countersunk head screw portion, and the countersunk head screw portion of the cylindrical body is accommodated in the connection cylinder in close contact with an end surface of the connection cylinder. According to this structure, for example, even when the countersunk head screw portion is damaged by internal explosion, the cylindrical body blocks the through hole of the connection cylinder, so that an impact on the external equipment can be reduced.

Also, in the pressure-resistant explosion-proof connector according to the present invention, the connection cylinder is fixed to the base joint by engaging means for engagement. Example of the engaging means include a knock pin and a calking tool. By using such engaging means, it is possible to prevent loosening between the connection cylinder and the base joint and separation thereof due to internal explosion.

Also, in the pressure-resistant explosion-proof connector according to the present invention, the base joint is formed on a side surface of a terminal flange that connects the canned motor pump and a terminal portion.

Moreover, in the pressure-resistant explosion-proof connector according to the present invention, the base joint is formed on one of an upper surface, a side surface and a bottom surface of the outer cylinder of the canned motor pump. The base joint may be located at a position at least in communication with the sealed space of the stator, and preferably at a position where pipes and lines are easily installed.

By using the present invention, even a different type of sensor can be mounted via a common connector, to thereby eliminate the need for replacement of a connector including a mounting base for each sensor.

DETAILED DESCRIPTION OF EMBODIMENTS OF THE INVENTION

In the following, a best mode for carrying out the present invention (referred to as embodiment below) will be described by reference to the drawings.

Figure 1A:
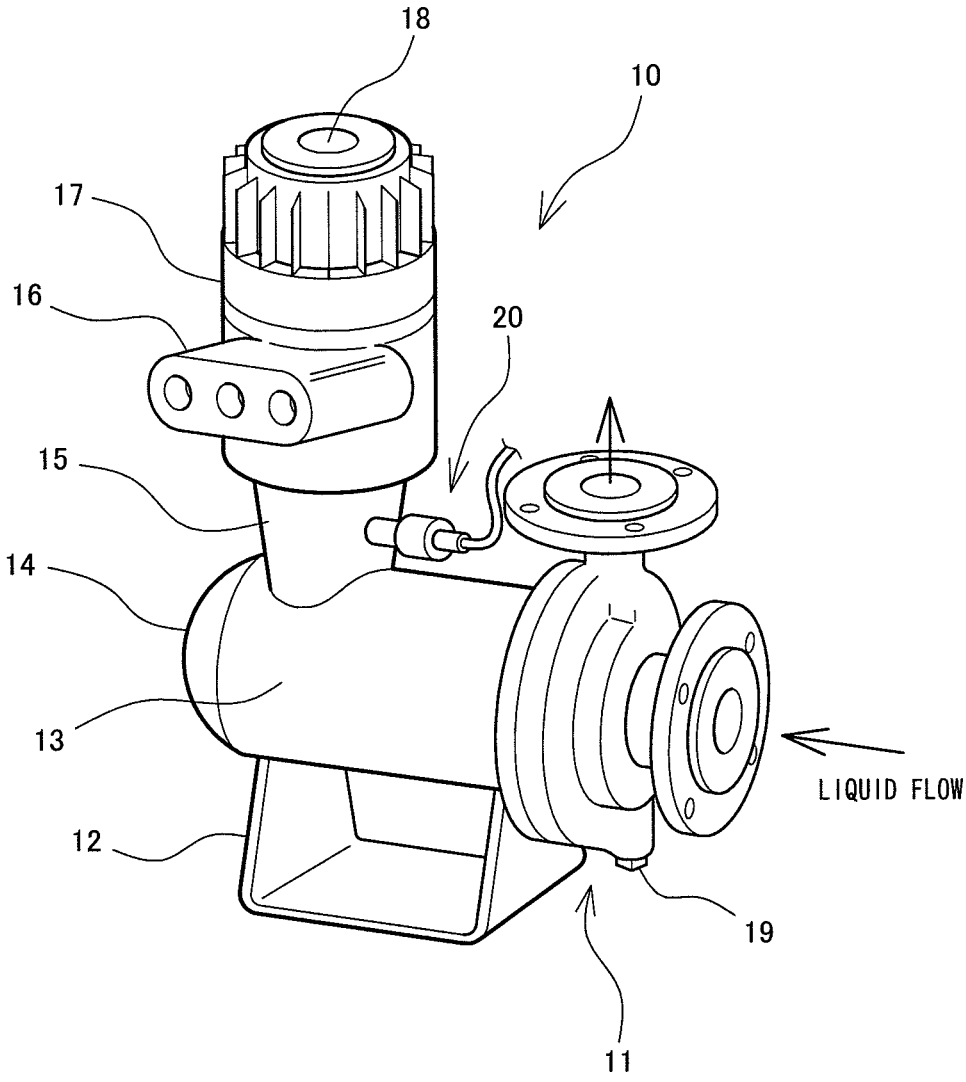
FIG. 1A is a perspective drawing of a canned motor pump to which a pressure-resistant explosion-proof connector according to an embodiment of the present invention is mounted.

FIG. 1A shows a canned motor pump 10 to which a pressure-resistant explosion-proof connector is mounted, and a pressure-resistant explosion-proof connector 20. The canned motor pump 10 includes a centrifugal pump 11, a stand 12 that supports a body, a motor 13, a bearing holder 14 of the motor 13, a terminal flange 15 mounted to an outer cylinder of the motor 13, a terminal box 16 mounted onto the terminal flange 15, a motor monitoring unit 17 mounted onto the terminal box 16, and the pressure-resistant explosion-proof connector 20 mounted to the terminal flange 15. A display window 18 that displays a bearing state is also provided in the motor monitoring unit 17. The canned motor pump 10 sucks a handled liquid from a front direction of the centrifugal pump 11, and discharges the handled liquid upward. Since the handled liquid is also circulated inside the motor, a drain screw 19 that allows the handled liquid inside the pump casing and the motor to be discharged is provided on a lower side of the centrifugal pump 11.

Figure 1B:
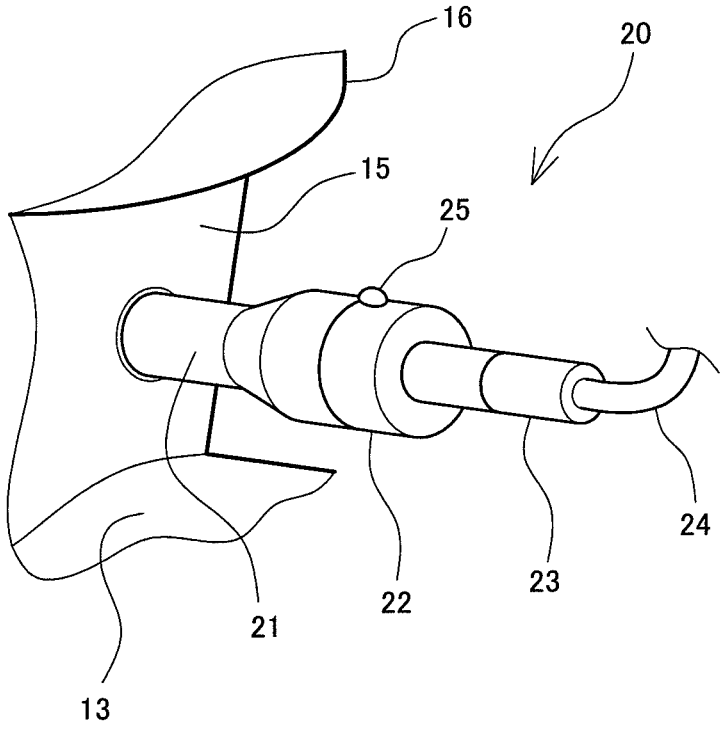
FIG. 1B is an enlarged drawing of the pressure-resistant explosion-proof connector shown in FIG. 1A.

The pressure-resistant explosion-proof connector 20 shown in FIG. 1B includes a base joint 21 mounted to the terminal flange 15, and a connection cylinder 22 connected to the base joint 21, and a pressure sensor 23 is connected to the connection cylinder 22. A cable 24 extends from the pressure sensor 23 (strain gauge type). A knock pin 25 (for fixing and for preventing loosening) is also provided on the pressure-resistant explosion-proof connector 20 so as to prevent the connection cylinder 22 from being detached from the base joint 21. Next, a liquid leaking state of the canned motor pump 10 will be described by using FIG. 2.

Figure 2:
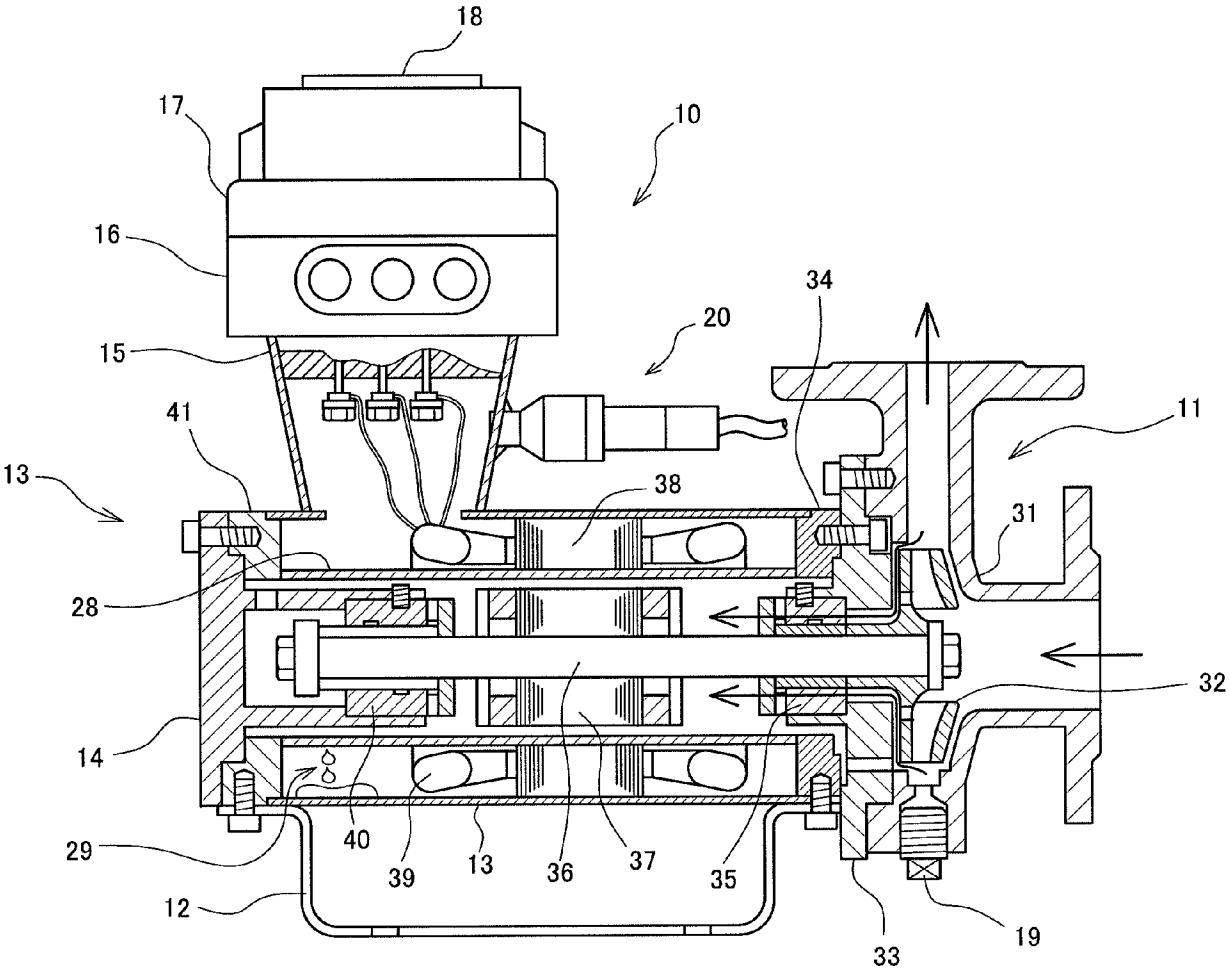
FIG. 2 is a sectional drawing of the canned motor pump to which the pressure-resistant explosion-proof connector according to the embodiment of the present invention is mounted.

FIG. 2 shows a section of the canned motor pump 10 to which the pressure-resistant explosion-proof connector 20 is mounted. In the canned motor pump 10, the centrifugal pump 11 and the motor 13 are connected to each other via a connection plate 33, a can 28 covers an inner portion of a stator 38 of the motor 13 that drives the centrifugal pump 11, and a region including the inside of the centrifugal pump 11, the connection plate 33, a sliding bearing 35,40 provided at the connection plate 33, and a sliding bearing 35,40 provided at the bearing holder 14 is filled with the handled liquid, so that a rotating portion of the pump is filled with the handled liquid. Accordingly, a shaft portion 36 that separates an impeller 32 and a rotor 37 does not need to be sealed, and a structure where the shaft 36 is supported only by the sliding bearing 40 is obtained. The handled liquid discharged by the impeller 32 is discharged from the centrifugal pump 11, and also used as a lubricating liquid of the sliding bearing 40 and a cooling liquid of the rotor 37.

Since the stator 38 is hermetically sealed by the can 28, the motor outer cylinder and end bells 34 and 41, a sealed space is formed in the stator portion 38, so that when the can 28 is damaged, the liquid leakage 29 does not occur outside and the liquid remains inside the stator. Also, due to a relationship between an inner pressure of the sealed space and a liquid pressure of the handled liquid, air inside the stator is released into the handled liquid, or the handled liquid flows out into the sealed space. Thus, when the can 28 is damaged, very small pressure variation occurs inside the sealed space. In the present embodiment, an electrical pressure sensor is provided via the pressure-resistant explosion-proof connector 20, so that even the very small pressure variation inside the can 28 can be detected, and the damage to the can 28 can be detected at an early stage.

In another embodiment, a semiconductor gas sensor is connected via the pressure-resistant explosion-proof connector 20. In the used semiconductor type gas sensor, tin oxide or the like that absorbs oxygen constitutes a porous body, and a gas concentration is measured based on a change in electric properties such as electric resistance caused when the absorbed oxygen is consumed by a reducing substance (methane, isobutane or the like). A crystal oscillation type gas sensor that detects gas based on a change in frequency of an oscillator caused when a chemical substance is attached to an oscillation surface, or a gas sensor that uses a surface acoustic wave, may be also used. By using such sensors, the damage to the can 28 can be detected at an earlier stage.

Figure 3:
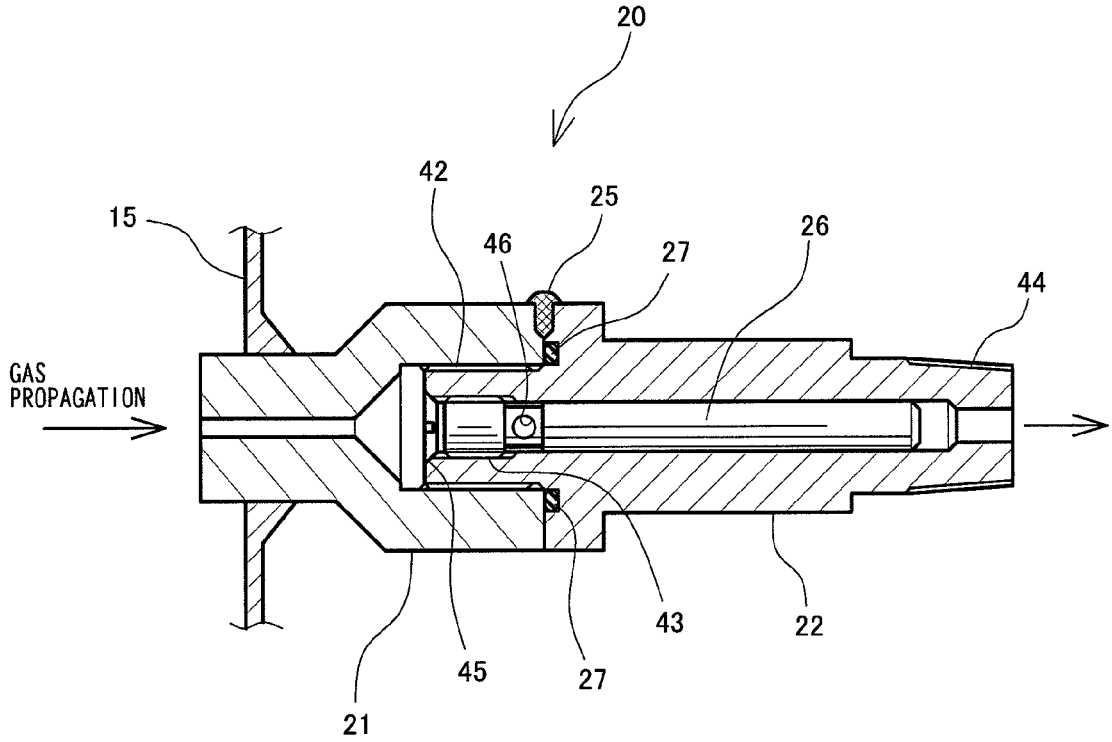
FIG. 3 is a sectional drawing of the pressure-resistant explosion-proof connector according to the embodiment of the present invention.

FIG. 3 is a sectional view of the pressure-resistant explosion-proof connector 20. The pressure-resistant explosion-proof connector 20 includes the base joint 21 mounted to the terminal flange 15, the connection cylinder 22 connected to the base joint 21 by a threaded portion 42, and the knock pin 25, and a aforementioned gas sensor is connected to the distal end of the connection cylinder 22, through which gas is propagated, by a threaded portion 44. Also, the connection cylinder 22 has a through hole therein, and accommodates a cylindrical body 26 connected thereto by a threaded portion 43, to thereby form a gap and define a depth and width of an explosion-proof gap. The knock pin 25 is a pin for preventing loosening and decomposition to prevent the connection cylinder 22 from being detached from the base joint 21. Next, the base joint 21, the cylindrical body 26 and the connection cylinder 22 that constitute the pressure-resistant explosion-proof connector 20 will be described.

Figure 4A:
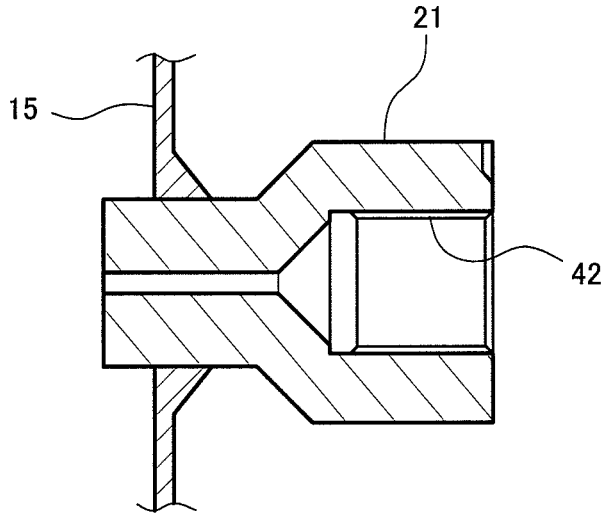
FIG. 4A is an explanatory drawing for explaining a constituent component of the pressure-resistant explosion-proof connector according to the embodiment of the present invention.
Figure 4B:
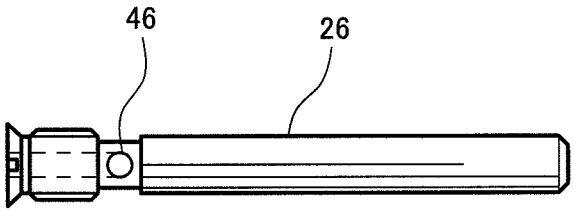
FIG. 4B is an explanatory drawing for explaining a constituent component of the pressure-resistant explosion-proof connector according to the embodiment of the present invention.
Figure 4C:
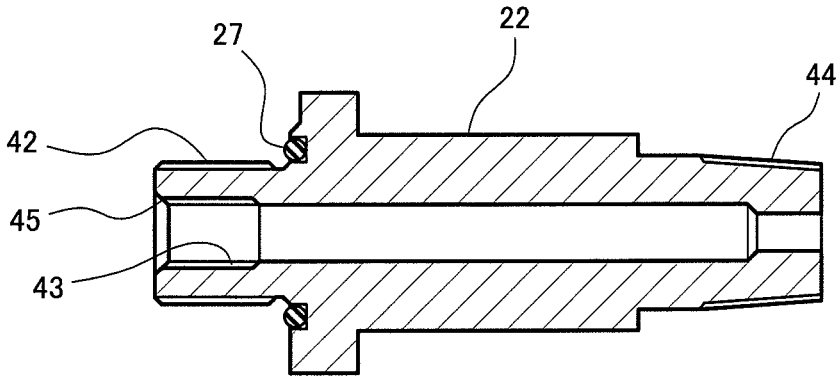
FIG. 4C is an explanatory drawing of a constituent component of the pressure-resistant explosion-proof connector according to the embodiment of the present invention.

FIG. 4 show the constituent parts of the pressure-resistant explosion-proof connector 20. The base joint 21 shown in FIG. 4A is fixed to the terminal flange 15 of the canned motor pump by welding or the like, and connected to the connection cylinder 22 shown in FIG. 4C by the threaded portion 42. The through hole is also provided inside the connection cylinder 22, and the cylindrical body 26 shown in FIG. 4B is connected to the through hole by the threaded portion. A male thread that allows the cylindrical body 26 to be screwed into the connection cylinder 22, a slotted groove fitted with a slotted screwdriver for rotating the male thread, and a conduit 46 are provided in the cylindrical body 26. An O-ring 27 that keeps an airtight connection with the base joint 21 is provided on a flange portion of the connection cylinder 22, and the threaded portion 44 that connects the sensor is provided at the other end of the connection cylinder 22.

One of features of the present embodiment is that a distal end of the through hole is formed in a tapered shape in the connection cylinder 22, and the cylindrical body 26 is fitted into the connection cylinder 22 along a gas propagation direction. The through hole may be a through hole with a constant diameter, or a stepped through hole or a tapered through hole that can restrict movement of the cylindrical body.

Figure 5:
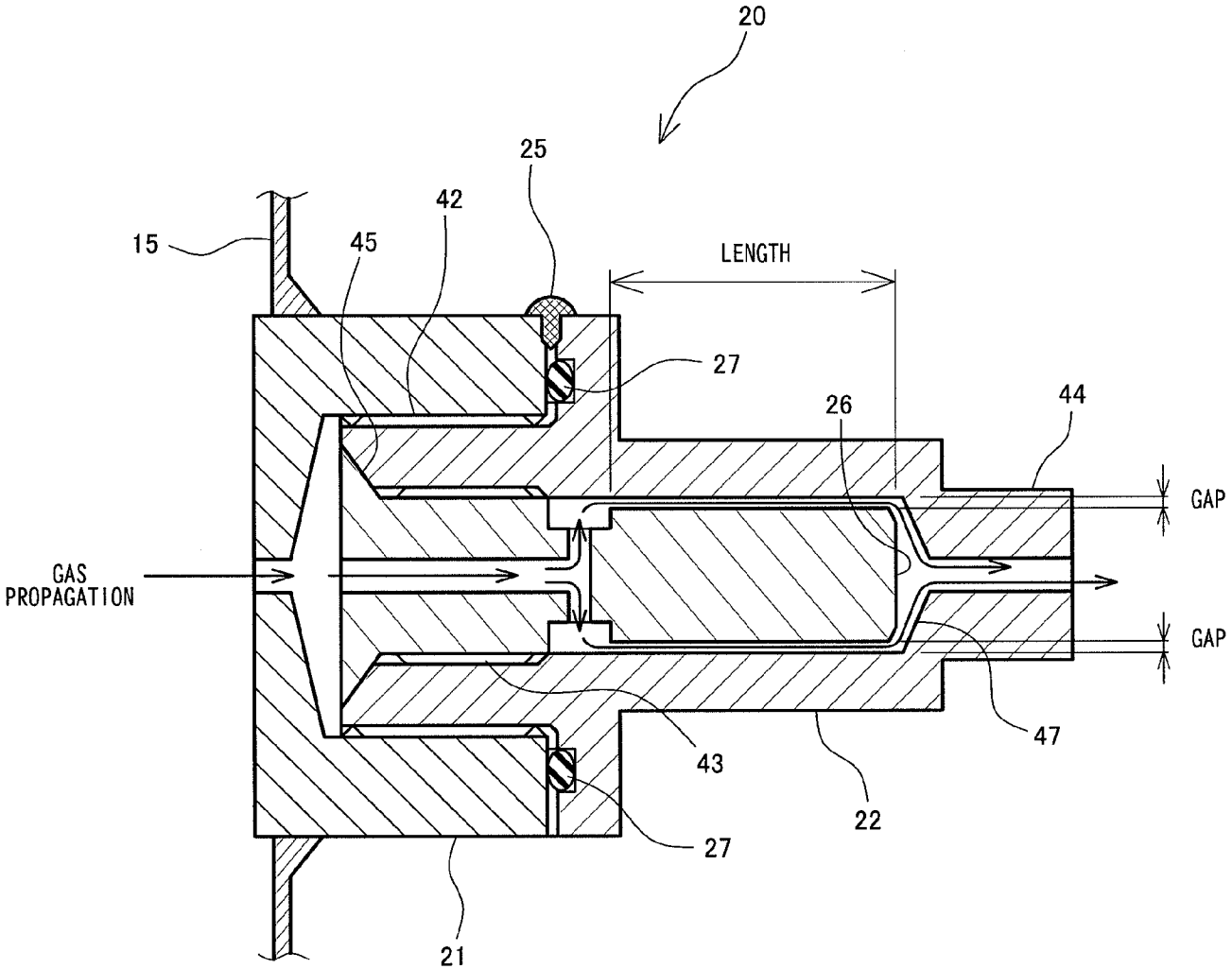
FIG. 5 is an explanatory drawing for explaining a gap of the pressure-resistant explosion-proof connector shown in FIG. 3.

FIG. 5 shows a depth (L) and a gap width (g) of the pressure-resistant explosion-proof connector 20 in FIG. 3. The construction requirements for explosive atmospheres set an interval and a depth of an explosion-proof gap in order to prevent a flame or spark from leaking outside. In the pressure-resistant explosion-proof connector 20 in the present embodiment, the depth (L) and the gap width (g) shown in FIG. 5 are formed, and even when the threaded portion 43 and a close contact portion 45,47 are damaged, a distal end portion of the cylindrical body 26 abuts against a close contact portion 45,47 of the stepped through hole of the connection cylinder to stop gas propagation. With such a structure, pressure-resistant explosion-proof performance can be ensured even when the sensor connected to the other end of the connection cylinder 22 is replaced.

Figure 6:
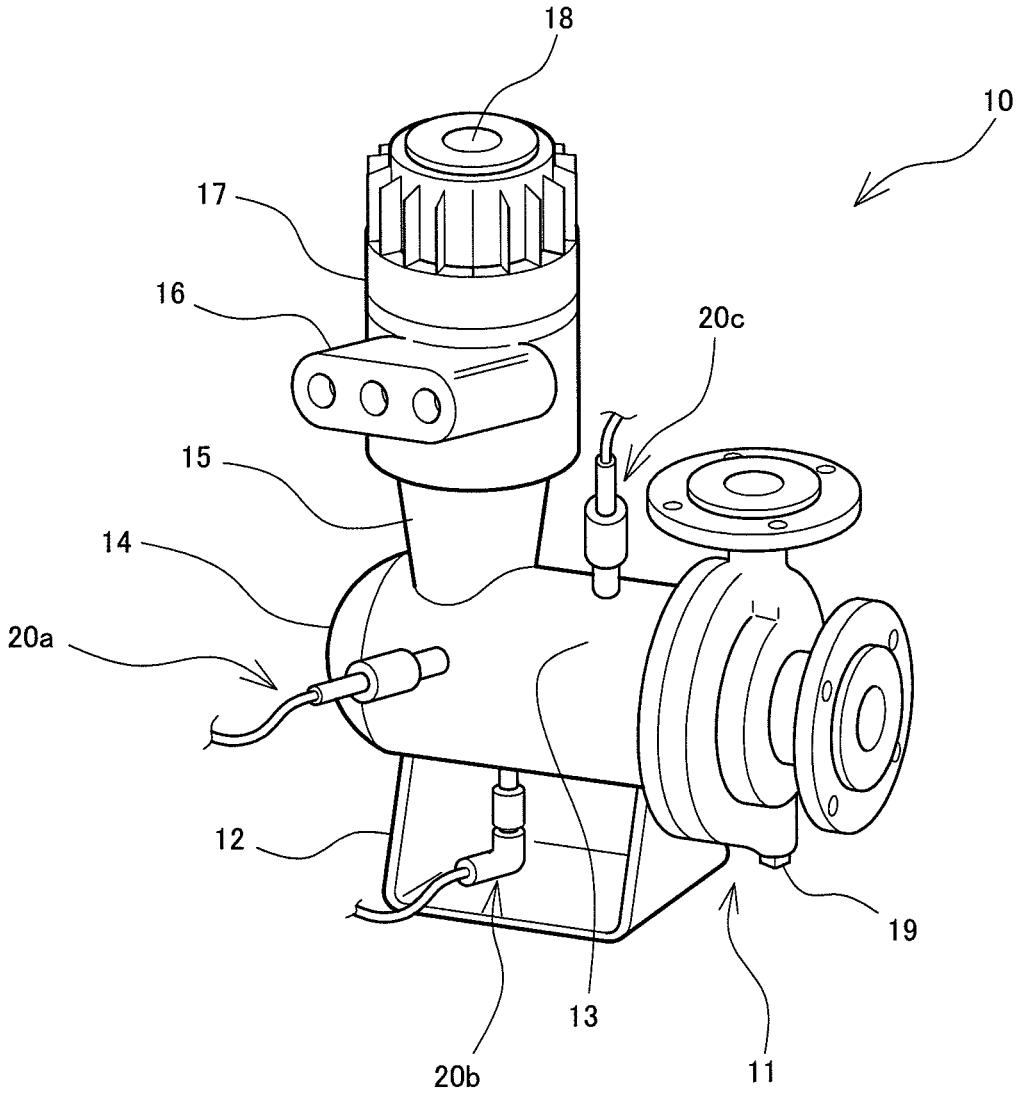
FIG. 6 is an explanatory drawing for explaining mounting positions of the pressure-resistant explosion-proof connector.
Figure 7:
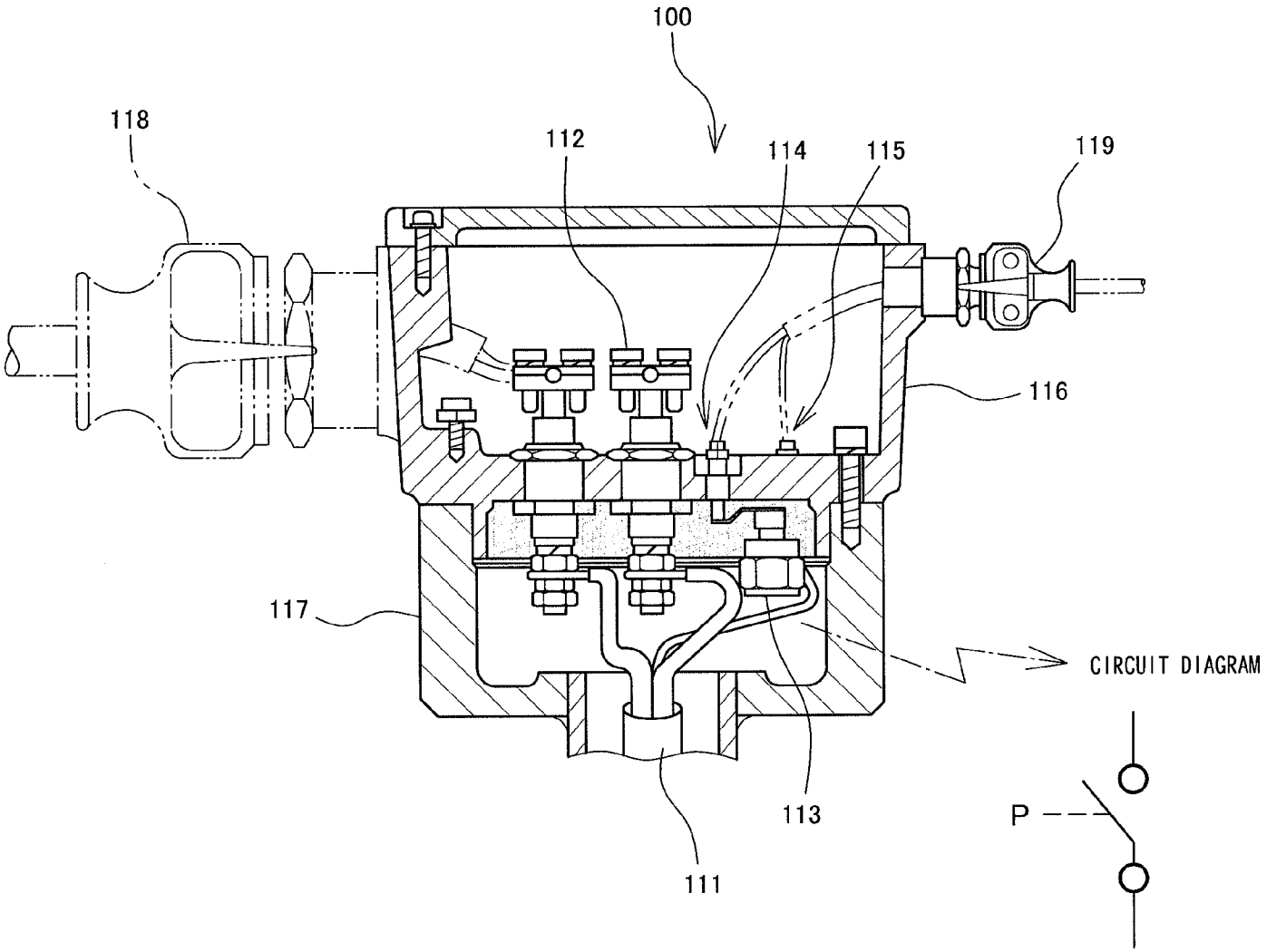
FIG.7 (Prior Art)
FIG. 7 is an explanatory drawing for explaining a pressure switch provided in a terminal box of a conventional canned motor pump.

FIG. 6 shows plural examples of a mounting position of the pressure-resistant explosion-proof connector 20. In the drawing, a pressure-resistant explosion-proof connector 20*a* is mounted to a side surface of the stator outer cylinder, a pressure-resistant explosion-proof connector 20*b* is mounted to a bottom surface of the stator outer cylinder, and a pressure-resistant explosion-proof connector 20*c* is mounted to an upper surface of the stator outer cylinder. Since the description regarding the canned motor pump 10 is similar to that in FIG. 1, the description regarding the canned motor pump 10 will be omitted.

In the canned motor pump 10 shown in FIG. 6, the pressure-resistant explosion-proof connector is provided not at the terminal flange 15 in the vicinity of the terminal box 16 to which the motor monitoring unit 17 is mounted, but at the outer cylinder of the stator. Generally, when leaking due to damage to the can, the handled liquid mostly remains in a lower portion of the stator. Thus, when the sensor is mounted to the upper side or the side surface of the stator outer cylinder below the terminal flange 15, the liquid leakage can be detected at an early stage.

When the pressure-resistant explosion-proof connector 20*b* is provided on the bottom surface of the stator, the fluid leakage can not only be detected at an early stage, but a chemical substance leaking into the sealed space of the stator can also be discharged by removing the sensor from the pressure-resistant explosion-proof connector, and the leaking handled liquid can also be easily collected by arranging an oil pan below the pressure-resistant explosion-proof connector.

As described above, by using the pressure-resistant explosion-proof connector according to the present embodiment, even a different type of sensor can be mounted via the common connector, to thereby eliminate the need for replacement of a connector including a mounting base with respect to each sensor. Although the pressure-resistant explosion-proof connector is described by employing the canned motor pump as an example in the present embodiment, the present invention is not limited thereto, and it goes without saying that the present invention can be applied to other equipment.

What is claimed is:

1. A pressure-resistant explosion-proof connector that connects external equipment to a sealed space of a stator portion hermetically sealed by a can in contact with a handled fluid, an end bell, and an outer cylinder of a canned motor pump, comprising:

a connection cylinder having a through hole extending from the sealed space toward the external equipment;

a cylindrical body mounted to the through hole of the connection cylinder to form a gap and a depth of an explosion-proof gap; and a base joint that connects the connection cylinder to the sealed space, wherein one end of the connection cylinder is connected to the canned motor pump through the base joint connected to the sealed space, and an other end of the connection cylinder is connected to the external equipment through a joint connected to the external equipment, and the connection cylinder having the through hole has a structure to resist an inner pressure generated by a leaking handled fluid or gas by receiving the cylindrical body from a side of the connection cylinder connected to the canned motor pump.

2. The pressure-resistant explosion-proof connector according to claim 1, wherein the other end of the connection cylinder is hermetically sealed by the external equipment.

3. The pressure-resistant explosion-proof connector according to claim 1, wherein a threaded groove is formed in the through hole of the connection cylinder, the cylindrical body has a countersunk head screw portion, and the countersunk head screw portion of the cylindrical body is accommodated in the connection cylinder in close contact with an end surface of the connection cylinder.

4. The pressure-resistant explosion-proof connector according to claim 3, wherein the connection cylinder is fixed to the base joint by engaging means for engagement.

5. The pressure-resistant explosion-proof connector according to claim 4, wherein the base joint is formed on a side surface of a terminal flange that connects the canned motor pump and a terminal portion.

6. The pressure-resistant explosion-proof connector according to claim 5, wherein the base joint is formed on one of an upper surface, a side surface and a bottom surface of the outer cylinder of the canned motor pump.

* * * * *